US007146396B2

(12) United States Patent
Rainish

(10) Patent No.: US 7,146,396 B2
(45) Date of Patent: Dec. 5, 2006

(54) METHOD AND APPARATUS OF CONVOLVING SIGNALS

(75) Inventor: Doron Rainish, Ramat-Gan (IL)

(73) Assignee: Intel Corporation, Santa Clara, CA (US)

( * ) Notice: Subject to any disclaimer, the term of this patent is extended or adjusted under 35 U.S.C. 154(b) by 680 days.

(21) Appl. No.: 10/149,470

(22) PCT Filed: Dec. 10, 2000

(86) PCT No.: PCT/IL00/00827

§ 371 (c)(1),
(2), (4) Date: Jun. 6, 2002

(87) PCT Pub. No.: WO01/43052

PCT Pub. Date: Jun. 14, 2001

(65) Prior Publication Data

US 2002/0198915 A1 Dec. 26, 2002

(30) Foreign Application Priority Data

Dec. 10, 1999 (IL) ..... 133451

(51) Int. Cl.
*G06G 7/12* (2006.01)

(52) U.S. Cl. ..... 708/813

(58) Field of Classification Search ..... 708/420, 708/813, 316, 3

See application file for complete search history.

(56) References Cited

U.S. PATENT DOCUMENTS 3,133,254 A 5/1964 Lindsey et al.
4,524,424 A * 6/1985 White ..... 708/322
4,641,260 A * 2/1987 Fukukita et al. ..... 708/530
4,894,660 A * 1/1990 Thomson et al. ..... 342/129
5,315,621 A * 5/1994 Lucioni et al. ..... 375/350
5,325,322 A 6/1994 Bailey et al.
5,668,832 A * 9/1997 Yamamoto ..... 375/233
5,781,063 A * 7/1998 Kub et al. ..... 327/552
5,859,787 A 1/1999 Wang et al.
5,983,139 A 11/1999 Zierhofer
6,370,397 B1 * 4/2002 Popovic et al. ..... 455/561

FOREIGN PATENT DOCUMENTS

FR 2 248 759 5/1975
GB 1 598 144 9/1981

OTHER PUBLICATIONS

Search Report from EP 00 98 1580.
Haque Y. and Copeland M., Design and Characterization of a Real-Time Correlator, IEEE Journal of Solid State Circuits, vol. SC-12, No. 6, Dec. 1997, pp. 642-649.
Budak A., "Passive and Active Network Analysis and Synthesis", Houghton Mifflin Company, Boston, US, 1974, Preface.

* cited by examiner

*Primary Examiner*—Tan V. Mai
(74) *Attorney, Agent, or Firm*—Pearl Cohen Zedek Latzer LLP

(57) ABSTRACT

A method of convoluting a first signal (32) and a second signal. The method includes generating a multiplication signal responsive to the second signal, multiplying (34) the first signal by a plurality of time shifted versions of the multiplication signal, integrating (38) the products of the multiplying of the first signal and the plurality of time shifted versions of the multiplication signal, the integrations being performed over a time period longer than the time difference between at least two of the time shifted versions, and providing an output signal based on the integrations of the products.

31 Claims, 5 Drawing Sheets

METHOD AND APPARATUS OF CONVOLVING SIGNALS

RELATED APPLICATIONS

The present application is a U.S. national phase application of PCT/IL00/00827, filed Dec. 10, 2000 designating the US, the disclosures of which are incorporated herein by reference.

FIELD OF THE INVENTION

The present invention relates to electronic processing and in particular to convolvers.

BACKGROUND OF THE INVENTION

Convolvers are used in numerous signal processing apparatus, such as communication apparatus. Convolvers perform the convolution operation on a pair of signals. Filters are a sub-group of convolvers which perform the convolution operation between an input signal and an impulse response of the filter. Correlators are another sub-group of convolvers in which the convolution operation is performed between a first input signal and the time inverse of a second input signal. For simplicity of the following description it is assumed that one of the convoluted signals has a finite duration.

Continuous time analog filters in which both the input and output are continuous analog signals, have been in use for a long time. Continuous time analog filters are actually analog convolvers which perform convolution between a continuous-time analog input and an impulse response of the filter. It is known to synthesize the filter's impulse response under certain constraints. Analog filters, however, suffer from inaccuracies due to the inaccuracies of electronic parts (e.g., resistors and capacitors) forming the analog convolvers. In addition, programmable continuous analog filters are substantially unfeasible to produce.

FIG. 1 is a schematic illustration of a discrete time convolver 28, known in the art. A first input signal x(t) is sampled at a rate 1/T by a switch 26, forming samples x(n). The samples x(n) are passed consecutively through a succession of delay units 20. The delayed samples x(n) from each delay unit 20 are multiplied at multipliers 22 by samples h(n) of a second input signal h(t) and the products of the multiplication are summed by an adder 24 which provides convoluted samples y(n) of an output signal y(t).

In some convolvers, delay units 20 are implemented using charge coupled devices (CCDs), samples x(n) and h(n) have analog (continuous) values and multipliers 22 are analog multipliers. CCD delay units and analog multipliers are generally small, simple, fast and consume little power. However, the samples running through the CCD delay units, suffer from degradation which limits the number of delay units which may be used in cascade and/or reduces the accuracy of the convolver.

To overcome the degradation, an implementation in which the samples x(n) are held in cyclic buffers and the h(j) samples are slid past the cyclic buffers to perform the multiplication, has been suggested. There also has been described a time discrete programmable analog-value filter which performs the addition and multiplication operations of the filter using capacitors.

In other convolvers, delay units 20 are implemented using digital registers which carry discrete values. The samples in these convolvers do not suffer from degradation, but the delay units have relatively high power consumption.

All the above discrete time convolvers receive sampled inputs x(n) and h(j). In order not to loose information, the continuous signals x(t) and h(t) must be sampled at a rate which is at least twice the respective signal's bandwidth. In many cases this requires very high sampling rates as h(t) is usually finite in time and has an infinite bandwidth. Also the high sampling rate requires in many cases using many delay units 20. In addition, an anti-aliasing filter is required in order to attenuate the aliasing frequencies created by the sampling.

BRIEF DESCRIPTION OF FIGURES

The invention will be more clearly understood by reference to the following description of embodiments thereof in conjunction with the figures, in which.

DETAILED DESCRIPTION OF EMBODIMENTS

An aspect of some embodiments of the invention relates to a convolver which operates on continuous input signals. A first signal is multiplied by a plurality of respective time shifted versions of a time inversion of the second signal. The products of the multiplications are integrated over the duration of the second signal (or the main part of the second signal when it is infinite). The results of the integrations are provided as samples of the convoluted signal.

In an embodiment of the invention, the convolver comprises a plurality of time-continuous multipliers and respective integrators. In some embodiments of the invention, the number of multipliers in the convolver is larger than the ratio between the duration of the second signal and a desired sampling time between the samples of the convoluted signal. Optionally, the number of multipliers is the smallest integer which is greater than the above ratio. It is noted that for many applications, the bandwidth of the convoluted signal is smaller than the bandwidth of the input signals and therefore the required sampling rate of the convoluted signal is usually lower than the sampling rate which would be required for the input signal.

Figure 1:
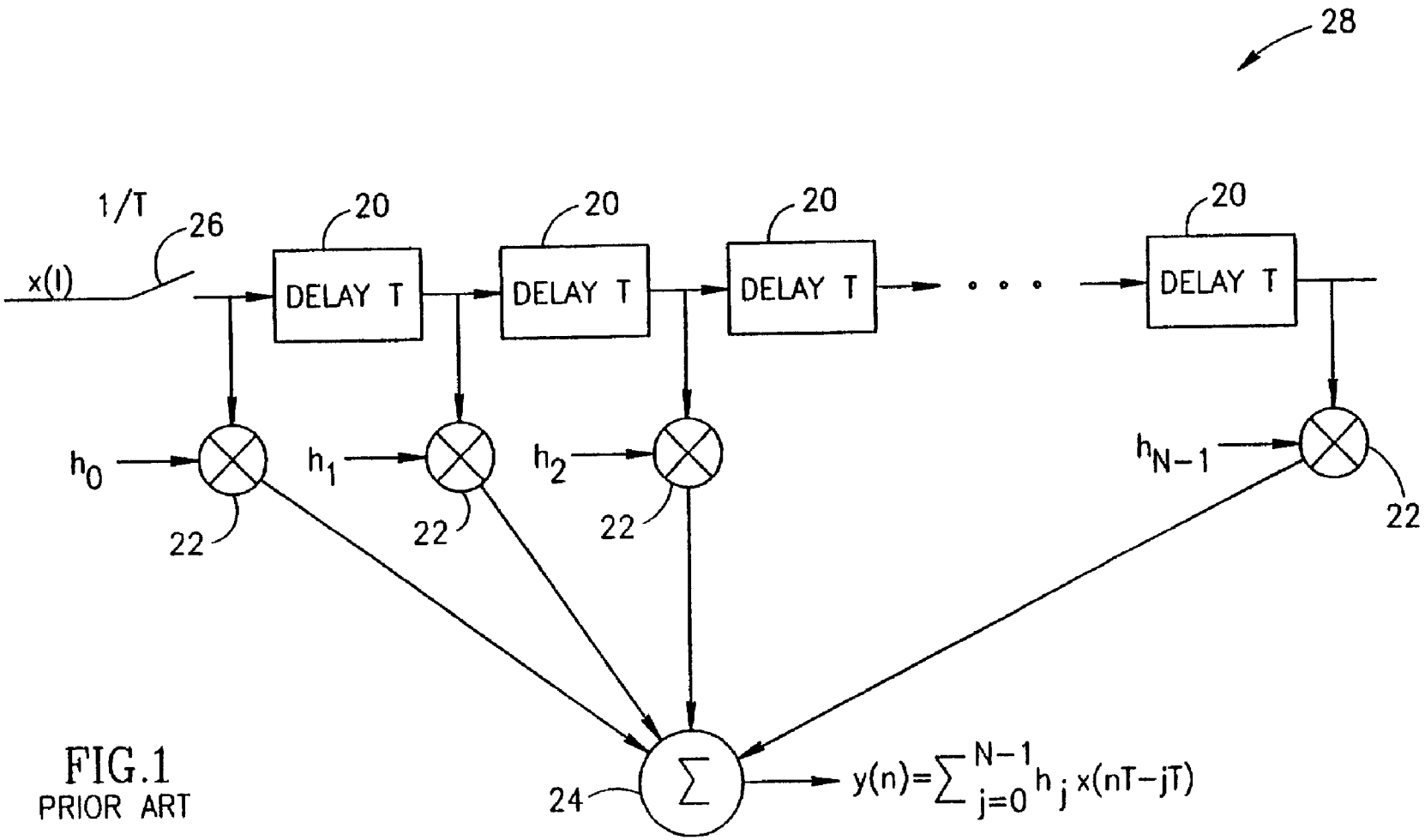
FIG.1 PRIOR ART
FIG. 1 is a schematic illustration of a convolver as is known in the art.
Figure 2:
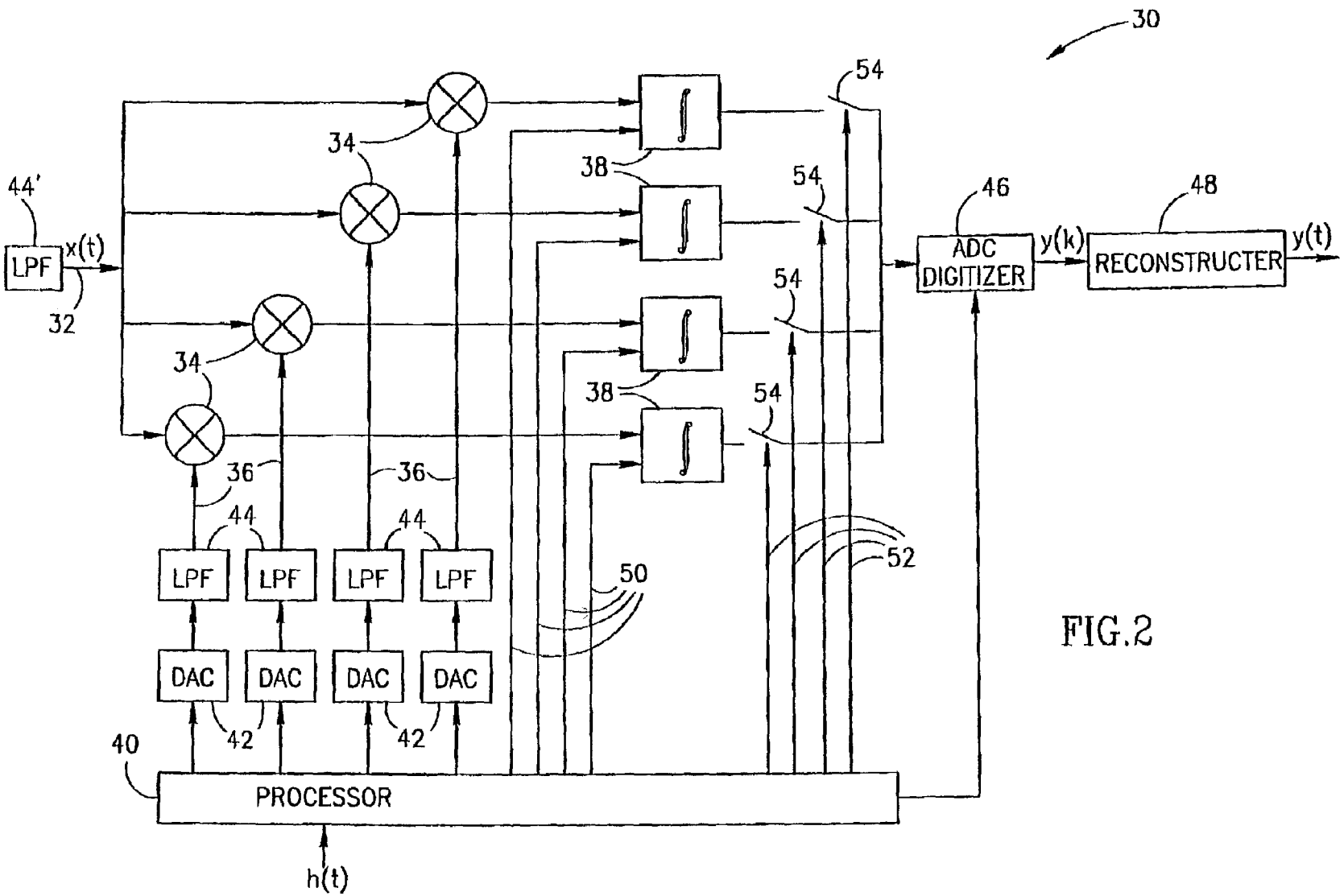
FIG. 2 is a schematic block diagram of a convolver, in accordance with an embodiment of the present invention.
Figure 3:
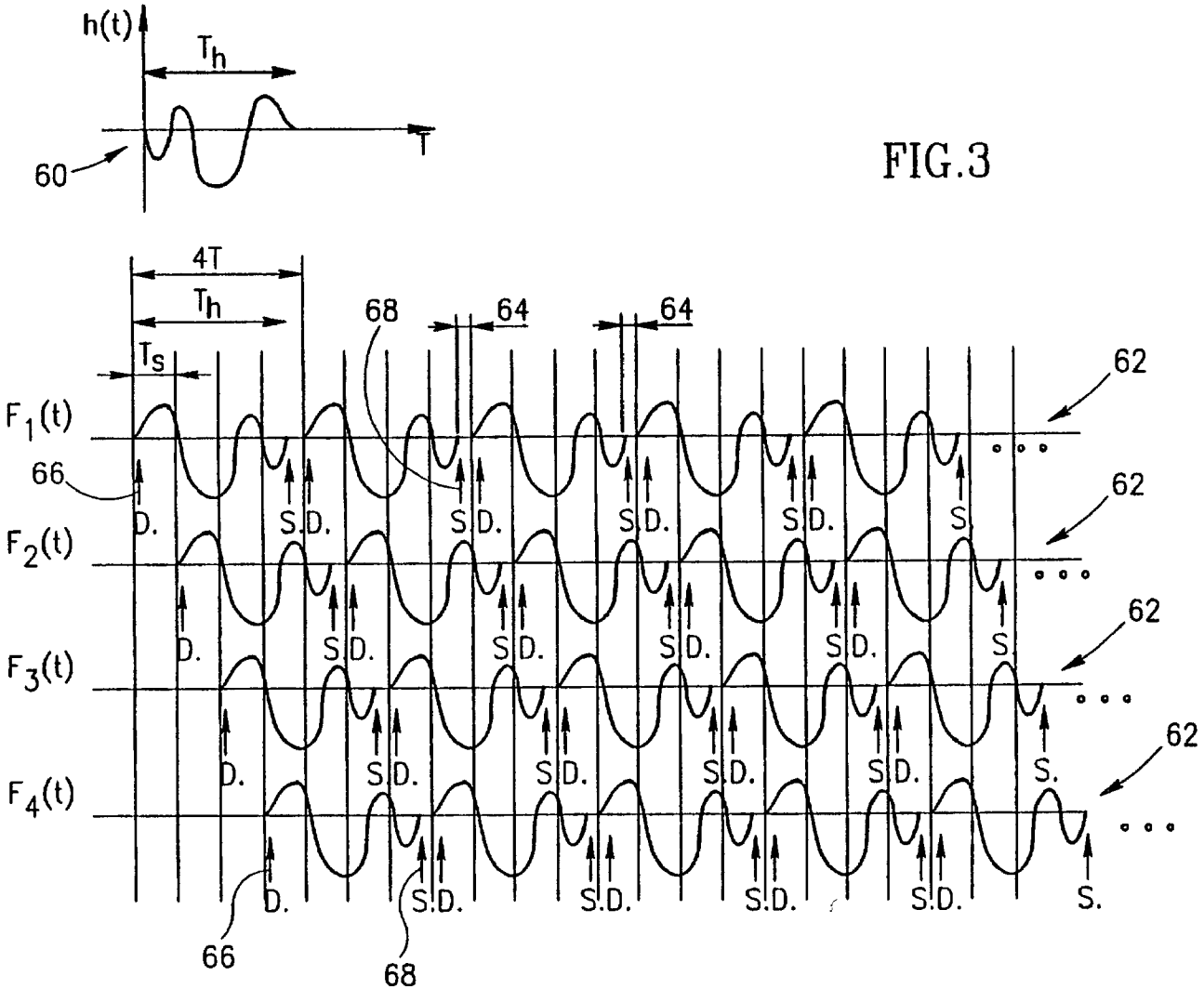
FIG. 3 is a time chart of the signals in the convolver of FIG. 2, in accordance with an embodiment of the present invention.

FIG. 2 is a schematic block diagram of a convolver 30, in accordance with an embodiment of the present invention. Reference is also made to FIG. 3 which is a time chart of the signals in a convolver 30 having four multipliers, in accordance with an embodiment of the present invention. Convolver 30 performs the convolution operation on a pair of continuous input signals x(t) and h(t) 60. Signal x(t) may be either finite or infinite in time while signal h(t) is finite in time, with a length $T_h$. It is noted that signal h(t) may be an approximation of an infinite signal in which most of the energy of the infinite signal is within $T_h$. A plurality of multipliers 34 repeatedly multiply input signal x(t), on a line 32, by a plurality of time shifted forms $\{f_k(t)\}=\{f_1(t), f_2(t), \ldots f_M(t)\}$ (M being the number of multipliers 34 in convolver 30) of a multiplication signal f(t), on lines 36. Multiplication signal f(t) is optionally a time reversed version of h(t). In some embodiments of the invention, the time shifted signals $f_k(t)$ are evenly shifted from each other by a time period $T_s$ (generally measured in seconds), i.e., $f_4(t)=f_3(t-T_s)=f_2(t-2T_s)=f_1(t-3T_s)$. In some embodiments of the invention, $T_s$ is chosen as the desired time period between consecutive output samples y(k). For example, $T_s$ may be chosen according to the bandwidth of the output signal y(t), such that y(t) may be constructed from samples y(k). In some embodiments of the invention, $T_s$ is shorter than $T_h$ such that time shifted signals $f_k(t)$ overlap in time.

In an embodiment of the invention, signals $f_k(t)$ are generated digitally by a processor 40. In some embodiments of the invention, processor 40 generates signals $f_k(t)$ periodically every $M*T_s$ seconds, forming cyclic signals $\{F_k(t)\}=\{F_1(t), F_2(t), \ldots, F_M(t)\}$ (62 in FIG. 3) of infinite nature. Thus, the generated signals $F_k(t)$ comprise infinite concatenations of signals $f_k(t)$ described by $$F_k(t) = \sum_{l=0}^{\infty} h(T_s(k + lM) + T_h - t).$$

It is noted that when $T_h$ is not evenly divisible by $T_s$, a gap 64 appears between the occurrences of $f_k(t)$ within their respective cyclic signals $F_k(t)$.

In an embodiment of the present invention, each of signals $F_k(t)$ is generated separately by processor 40. Alternatively, a single signal is generated by processor 40 and signals $F_k(t)$ are received from the generated signal by passing the generated signal through analog or digital delay units of suitable delay durations.

The generated signals are optionally passed through digital to analog converters (DAC) 42 and low pass filters (LPF) 44 which remove any aliasing effects, due to the generation of the signals from time discrete samples. Alternatively or additionally, convolver 30 comprises a low pass filter 44' which filters signal x(t) as it is received.

A plurality of integrators 38, one for each multiplier 34, integrate the multiplied signals over the respective lengths of the shifted multiplication signals $f_k(t)$. Samplers 54 pass the integration result, at the respective ending of the multiplied $f_k(t)$, to a digitizer 46 which digitizes the integration results providing digitized values y(k). The digitized values y(k) from digitizer 46 are defined by $$y(k) = \int_{t_k}^{t_k+T_h} h(t_k + T_h - \tau)x(\tau)d\tau$$

($t_k$ being the time of sample k) which are samples of the convolution of x(t) and h(t). It is noted that the operation of samplers 54 multiplexes the samples from integrators 38 to digitizer 46.

In an embodiment of the invention, the digitized values y(k) are provided as the output of convolver 30. This embodiment is especially useful, when the result of the convolution is passed for additional digital processing. Alternatively, digitizer 46 is not used and convolver 30 provides non-digitized samples.

In another embodiment of the invention, a reconstructer 48 converts the samplings y(k) to an analog form y(t). This embodiment may be implemented with or without digitizer 46. Optionally, reconstructer 48 comprises a reconstruction filter. Alternatively, reconstructer 48 comprises a sample-and-hold unit, or a digital to analog converter, which is followed by a reconstruction filter.

In an embodiment of the invention, processor 40, or an additional or other processor, generates control signals which time the operation of integrators 38 and/or samplers 54. Optionally, dump signals $D_k(t)$ 66 on lines 50, clear the memory of integrators 38 at the beginning of the respective multiplication signal $f_k(t)$ of the integrator. Dump signals $D_k(t)$ are optionally governed by the equation $$D_k(t) = \sum_{l=0}^{\infty} \delta[t - T_s(k + lM)]$$

in which δ(t) designates a pulse function which has a zero value at all times except t=0. It is noted that the memory of integrator 38 is cleared when the dump signal $D_k(t)$ received by the integrator has a non-zero value. Sampling signals $S_k(t)$ 68 on lines 52, optionally activate samplers 54 at the respective ends of signals $f_k(t)$. The sampling signals $S_k(t)$ optionally follow the equation $$S_k(t) = \sum_{l=0}^{\infty} \delta[t - T_s(k + lM) - T_h].$$

The samplings are performed, when the value of the sampling signal $S_k(t)$ is non-zero.

The number M of multipliers 34 and integrators 38 in convolver 30 is optionally larger than the ratio of $T_h$, the length of multiplication signal f(t), and $T_s$, the time period between time shifted signals $f_k(t)$. This number of multipliers allows concurrent multiplication of x(t) by M partially overlapping multiplication signals $f_k(t)$. Optionally, the number of multipliers is the smallest integer which is greater than the ratio of $T_h$ and $T_s$.

It is noted, that although in the above description multipliers 34 and integrators 38 are shown separately, in some embodiments of the invention, the multiplication may be performed by a circuit implementing the integration. For example, integrator 38 may have a variable input gain which is controlled by h(t) or is preprogrammed in the form of h(t).

In some embodiments of the invention, signal h(t) is an impulse response of a filter. Optionally, the impulse response is generated by processor 40 based on user programming, as is known in the art. Alternatively, signal h(t) is an input signal received by processor 40. In some embodiments of the invention, the received signal h(t) is digitized and stored within a memory of processor 40 and is used to produce signals $F_k(t)$. Storing the digitized form of h(t) within processor 40, allows easy generation of the delayed versions of $F_k(t)$, and allows simple replacement of h(t).

When x(t) is an infinite signal, multipliers 34 and integrators 38 optionally continuously operate, generating an infinite output signal y(k). When x(t) is a finite signal, multipliers 34 and integrators 38 optionally continuously operate until a little after the end of x(t) is reached, when y(n) becomes continuously zero. In some embodiments of the invention, at the end of a finite input signal x(t), a constant zero signal is entered on line 32.

Although in the above description processor 40 is used to generate cyclic signals $F_k(t)$, any other apparatus may be used to generate signals $F_k(t)$, such as one or more analog repeaters.

It is noted that, although for the simplicity of the implementation of convolver 30, signals $f_k(t)$ are optionally evenly shifted relative to each other, this requirement is not essential. That is, samplers 54 may pass the integration results in non-even intervals. Optionally, in such cases reconstructer 48 performs a weighted reconstruction based on the intervals between the samples y(n). Alternatively or additionally, any other compensation method known in the art may be used to compensate for the non-even sampling intervals.

Although in the above description convolver 30 repeatedly multiplies x(t) by the same signal f(t), in some embodiments of the invention convolver 30 is used to convolute x(t) with different signals $h_\Theta(t)$, where Θ designates the time at which the time interval $T_h(\Theta)$ of $h_\Theta(t)$ begins. In these embodiments, $F_k(t)$ are not cyclic, but rather are formed of a concatenation of respective multiplication signals $f_\Theta(t)$ of the $h_\Theta(t)$ signals. Thus, $F_k(t)$ are denoted by:

$$F_k(t) = \sum_{l=0}^{\infty} h_{T_s(k+lM)}(T_s(k+lM)+T_h-t)$$

in which k designates a respective branch (i.e., multiplier and integrator) of convolver 100, M represents the number of branches in convolver 100, and $T_s$ is the time between the providing of two output samples.

Convolution with varying signals $h_\Theta(t)$ may be used, for example, in implementing an adaptive filter in which the specific function $h_\Theta(t)$ used at any specific time is a function of time, of the input signal and/or of a specific mode of operation of the convolver. In some embodiments of the invention, convolver 30 is used to implement a matched filter for operation in a time varying channel and the specific function $h_\Theta(t)$ used at any specific time is a function of the channel response at the specific time.

In some embodiments of the invention, the number of multipliers 34 which are used in convolver 30 may vary. For example, at a time Θ when $T_h$, the length of $h_\Theta(t)$, is relatively short, one or more of multipliers 34 are not used, e.g., are disconnected from line 32 which provides x(t), so as to reduce the current consumption of convolver 30. Optionally, each time a new $h_\Theta(t)$ signal is used, the length $T_h$ of the signal is determined and the number of multipliers 34 to be used, is determined accordingly.

In some embodiments of the invention, the time period $T_s$ between two signals $f_k(t)$ may change during the operation of convolver 30, for example as a function of $T_h$. Lengthening $T_s$, may reduce the number of multipliers required and thus reduces the current consumption of convolver 30. In some embodiments of the invention, the changing of $T_s$ is performed by adjusting the timing between the control signals on lines 50 and 52, adjusting the timing of signals F and optionally setting the timing and/or operation parameters of reconstructer 48.

In some embodiments of the invention, the time period $T_s$ is adjusted as a function of the bandwidth of the convoluted signal y(t), which is a function of the bandwidth of x(t) and h(t). Optionally, $T_s$ is adjusted periodically, as a function of the present bandwidth of y(t). When the bandwidth of y(t) decreases, for example due to a decrease in the bandwidth of x(t), $T_s$ is increased in order to reduce the current consumption of convolver 30. When, on the other hand, the bandwidth of y(t) increases, $T_s$ is decreased in order to allow reconstruction of y(t) from the samples y(n), at a sufficient accuracy. Alternatively or additionally, $T_s$ is adjusted as a function of the present bandwidth of h(t), for example, each time h(t) changes. For example, when $T_h$ increases the bandwidth of h(t) generally decreases. The number of multipliers 34 which are to be used depends on the length of h(t), $T_h$, and its bandwidth. In some embodiments of the invention, the number of multipliers 34 which are used is kept substantially constant even when h(t) changes. When the length of h(t) increases $T_s$ is likewise increased so that the ratio between $T_h$ and $T_s$ remains substantially constant. This is generally possible when the increase of the length of h(t) reduces the bandwidth of y(t).

Figure 4:
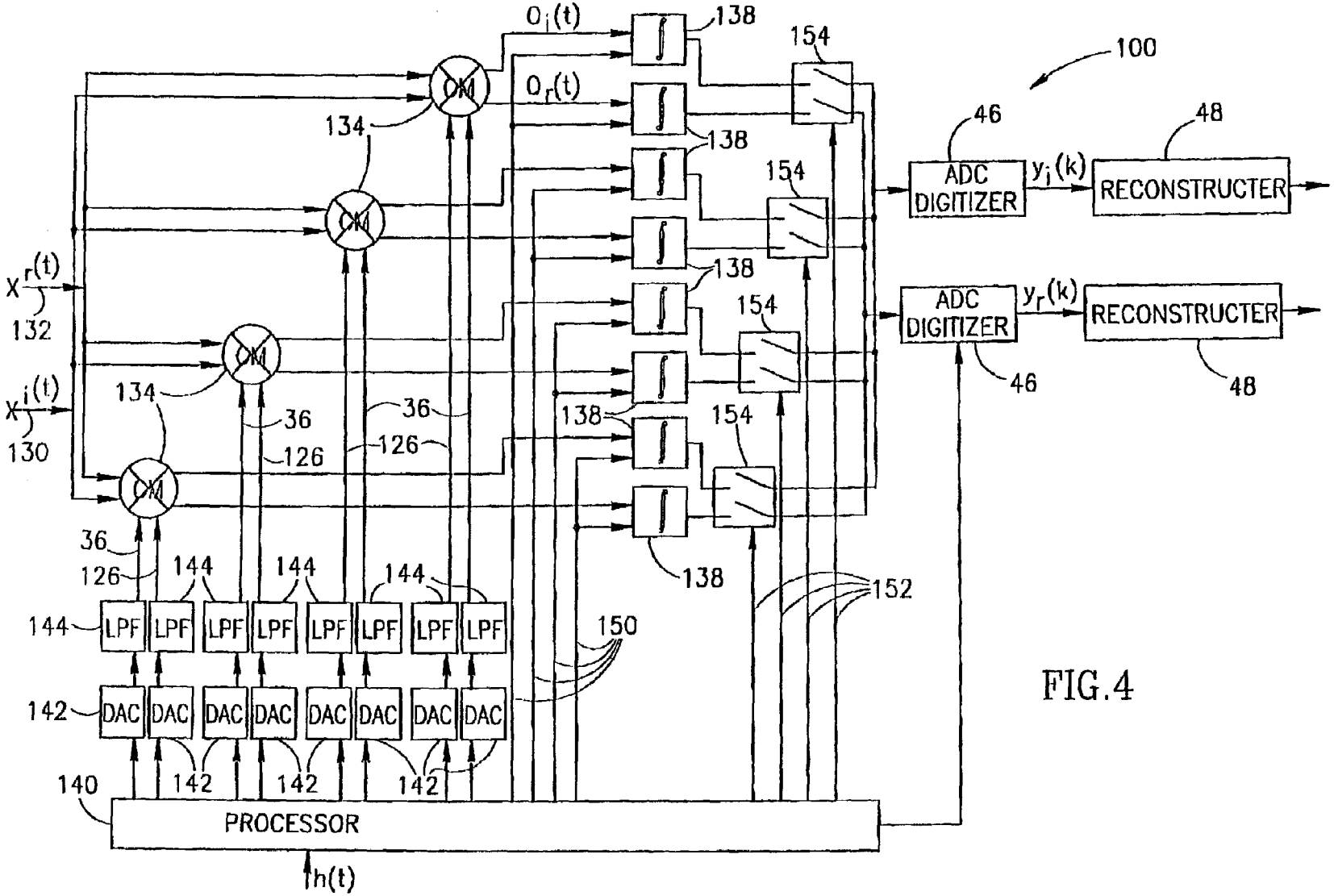
FIG. 4 is a schematic block diagram of a complex convolver, in accordance with an embodiment of the present invention.

FIG. 4 is a schematic block diagram of a complex convolver 100, in accordance with an embodiment of the present invention. Complex convolver 100 is similar to convolver 30 in accordance with any of the above described embodiments, but performs a complex convolution operation. Complex convolver 100 performs a complex convolution operation between the complex signals $x_c(t)=\{x_r(t), x_i(t)\}$ and $h_c(t)=\{h_r(t), h_i(t)\}$ to provide a convoluted signal $y_c(t)=\{y_r(t), y_i(t)\}$. Complex convolver 100 receives the real signal $x_r(t)$ on an input line 132 and an imaginary signal $x_i(t)$ on an input line 130. A processor 140 generates real and imaginary signals, $F_{kr}(t)$ and $F_{ki}(t)$ respectively, from user programmed or input signals $h_r(t)$ and $h_i(t)$ respectively, using any of the methods described above with relation to convolver 30. Optionally, the generated signals $F_{kr}(t)$ and $F_{ki}(t)$ are generated as digital signals and are passed through respective digital to analog converters (DAC) 142 and possibly respective filters 144. In some embodiments of the invention, DACs 142 and/or filters 144 of a single pair of signals $F_{kr}(t)$ and $F_{ki}(t)$ are included in a single element.

A plurality (M) of complex multipliers 134 receive copies of $x_r(t)$ and $x_i(t)$ and respective signals $F_{kr}(t)$ and $F_{ki}(t)$, k=1 . . . M, (i.e., a first complex multiplier receives $F_{1r}(t)$ and $F_{1i}(t)$, a second complex multiplier receives $F_{2r}(t)$ and $F_{2i}(t)$, etc.) and provide output signals $O_r(t)$ and $O_i(t)$. In some embodiments of the invention, output signals $O_r(t)$ and $O_i(t)$ are provided to respective integrators 138 which integrate the output signals separately and the results of the integration are sampled by double switches 154 which provide separate real and imaginary samples. The samples are provided in accordance with the same timing rules as described above with respect to convolver 30.

In some embodiments of the invention, the samples are both passed through ADC digitizers 46 and/or reconstructers 48 to provide convoluted signals $y_r(t)$ and $y_i(t)$, or are both provided as samples. Alternatively, the imaginary output signal is provided in a different form than the real output signal. For example, the imaginary output signal may be passed through an ADC digitizer 46 and a reconstructer 48 so as to provide an analog signal, while the real output signal is provided as samples.

Figure 5:
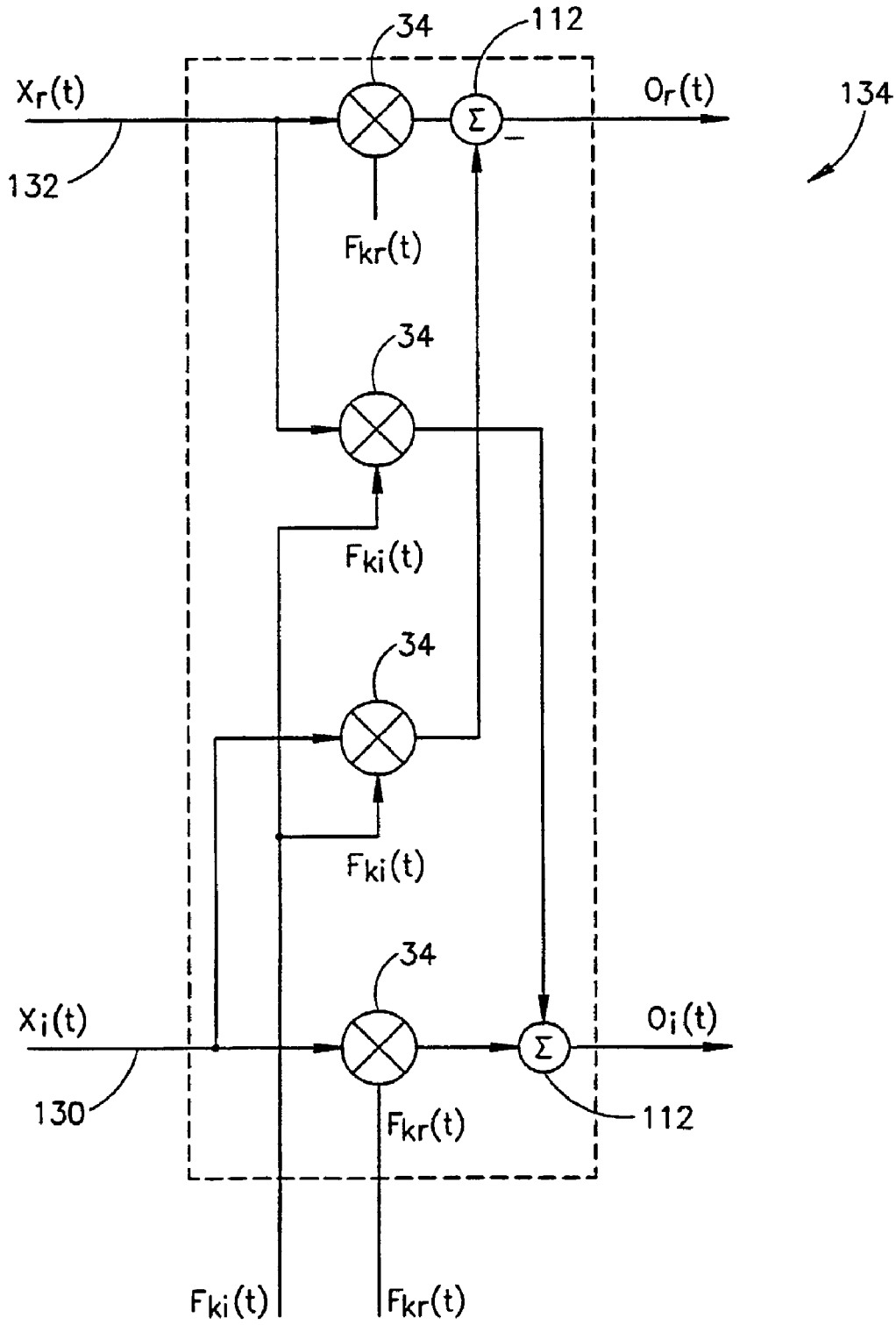
FIG. 5 is a schematic block diagram of a complex multiplier, in accordance with an embodiment of the present invention.

FIG. 5 is a schematic block diagram of a complex multiplier 134, in accordance with an embodiment of the present invention. Complex multiplier 134 performs the signal operation:

$$O_r(t)=x_r(t)\cdot F_{kr}(t)-x_i(t)\cdot F_{ki}(t)$$

$$O_i(t)=x_r(t)\cdot F_{ki}(t)+x_i(t)\cdot F_{kr}(t) \quad (1)$$

In some embodiments of the invention, complex multiplier 134 comprises four multipliers 34 and two adders 112 which perform the operations of equation (1). Alternatively, an integrator is located at the output of each multiplier 34 and adders 112 sum the outputs of the integrators. Further alternatively or additionally, some of the calculations are performed by different elements, e.g., by combined elements. For example, instead of using multipliers 34, adders 112 may have inputs with variable gains. Alternatively or additionally, instead of adders 112, integrators with multiple inputs may be used.

In some embodiments of the invention, the complex convolver 100 may be used both for complex convolution and for real convolution. When real convolution is to be performed by complex convolver 100, input line 130 and imaginary signal $F_{ki}(t)$ are set to a constant zero signal. In some embodiments of the invention, complex convolver 100 may be used also to perform convolution between a real input signal x(t) and a complex generated signal h(t), by providing a constant zero signal on input line 130 or between a complex input signal and a real generated signal h(t), by providing a constant zero signal instead of imaginary signal $F_{ki}(t)$.

In some embodiments of the invention, a convolver is initially constructed for performing a convolution between a real signal and a complex signal. Such a convolver may be constructed by removing from the description of complex convolver 100 lines which are not required, i.e., would constantly carry a zero signal. The complex multipliers of such convolvers optionally include two multipliers and do not include adders.

Convolvers in accordance with embodiments of the present invention may be used in substantially any apparatus which requires a convolver, including communication apparatus, such as radio receivers. In an exemplary embodiment of the invention, a convolver with a real input and a real output is used as a filter of an intermediate frequency (IF) signal in a receiver which uses the IF signal for detection. The programmability of the h(t) signal representing the filter allows configuration of the convolver to operate as a filter with different bandwidths and/or different filter shapes according to the specific input signal and/or operation mode of the receiver.

In another exemplary embodiment of the invention, a convolver with a complex input and a real h(t) signal representing a filter is used for filtering base-band signals of a receiver after I-Q demodulation of the signals.

It is noted that the real and imaginary signals of complex convolver 100 are not necessarily in phase. In an exemplary embodiment of the invention, a convolver with a real x(t) and a complex F(t) is used in a radio receiver to concurrently filter and sample an RF or intermediate frequency (IF) signal. The samples are taken at specific times such that the samples may be used to reconstruct I and Q signals at a base band frequency. In this embodiment, $1/T_s$ is optionally equal to a desired sampling rate of the output base band signal, which sampling rate is generally chosen according to the bandwidth of the base band signal. In some embodiments of the invention, $F_{ki}(t)$ is shifted relative to $F_{kr}(t)$ by $T_{RF}/4$, where $1/T_{RF}$ is the frequency of the RF or IF signal. Because $F_{ki}(t)$ is shifted relative to $F_{kr}(t)$, the sampling of the real and imaginary output signals may be performed concurrently, thus simplifying convolver 100 and the receiver.

It will be appreciated that the above described methods may be varied in many ways, including, changing the order of steps, and the exact implementation used. It should also be appreciated that the above described description of methods and apparatus are to be interpreted as including apparatus for carrying out the methods and methods of using the apparatus.

The present invention has been described using non-limiting detailed descriptions of embodiments thereof that are provided by way of example and are not intended to limit the scope of the invention. Variations of embodiments described will occur to persons of the art. Furthermore, the terms "comprise," "include," "have" and their conjugates, shall mean, when used in the claims, "including but not necessarily limited to." The scope of the invention is limited only by the following claims:

The invention claimed is:

1. A method of convolving comprising:

generating a multiplication signal;

multiplying an input signal by a plurality of shifted time reversed versions of the multiplication signal to provide a plurality of products corresponding to the multiplying of the input signal by the plurality of shifted time reversed versions of the multiplication signal, respectively;

integrating the products over a time period longer than the time difference between at least two of the shifted time reversed versions; and providing an output signal based on the integrations of the products.

2. A method according to claim 1, wherein generating the multiplication signal comprises generating a signal which is non-zero in a finite time period.

3. A method according to claim 1, wherein integrating the products comprises integrating over a length of the multiplication signal.

4. A method according to claim 1, comprising:

sampling the output signals to provide samples to an analog to digital converter.

5. A method according to claim 4, wherein providing the samples comprises providing samples with a time difference between at least two adjacent samples in the series which is shorter than at least one of the shifted time reversed versions of the multiplication signal.

6. A method according to claim 1, wherein providing the output signal comprises providing digitized samples from the integrations of the products.

7. A method according to claim 1, wherein providing the output signal comprises providing a series of samples in which the difference between at least two adjacent samples is shorter than the length of the second signal.

8. A method according to claim 1, wherein providing the output signal comprises providing a reconstructed time continuous signal.

9. A method according to claim 1, comprising:

generating at least two reversed versions of the multiplication signal that are partially overlapping in time.

10. A method according to claim 1, wherein the input and multiplying signals comprise complex signals each formed of a pair of real and imaginary signals.

11. A method according to claim 1, wherein multiplying comprises performing complex multiplication.

12. A method of claim 1, wherein integrating the products comprises:

integrating the products over a time period longer than the time difference between at least two of the time shifted versions.

13. A method according to claim 1, wherein multiplying the input signal by the plurality of shifted time reversed versions of a multiplication signal comprises periodically selecting a shifted time reversed version of the multiplication signal to multiply by the input signal.

14. A method according to claim 1, wherein providing the output signal comprises providing samples at a variable rate.

15. A method according to claim 14, wherein providing samples at the variable rate comprises providing samples at a rate which is adjusted responsive to the bandwidth of the output signal.

16. A convolver, comprising:

a plurality of multipliers adapted to multiply an input signal by a plurality of shifted time reversed versions of a multiplication signal;

a plurality of integrators adapted to respectively integrate products received from the plurality of multipliers; and at least one sampler adapted to provide samples from outputs of the plurality of integrators.

17. A convolver according to claim 16, wherein the at least one sampler comprises a plurality of samplers which in combination provide samples with an interval shorter than the length of at least some of the multiplication signals between adjacent samples.

18. A convolver according to claim 17, wherein the number of multipliers is the smallest integer greater than the ratio between a length of the multiplication signals and the interval between adjacent provided samples.

19. A convolver according to claim 16, comprising:

a reconstructer to generate a reconstructed time continuous signal from the samples provided by the at least one sampler.

20. A convolver according to claim 16, comprising a digitizer which generates discrete-value samples from the samples provided by the at least one sampler.

21. A convolver according to claim 16, wherein at least one of the multipliers comprises a complex multiplier.

22. A convolver according to claim 16, comprising at least one combined multiplication and integration circuit which comprises one of the multipliers and one of the integrators.

23. A convolver according to claim 16, wherein the multipliers comprise analog multipliers.

24. A convolver according to claim 16, wherein the integrators are adapted to begin integrating at different times.

25. An apparatus, comprising:

a digital signal processor adapted to generate two or more shifted time reversed versions of a multiplication signal;

two or more multipliers adapted to multiply an input signal by the two or more shifted time reversed versions of the multiplication signal generated by the processor;

two or more integrators adapted to respectively integrate products received from the two or more multipliers and so as to provide a convolved signal; and a sampler adapted to provide samples of the convolved signal.

26. The apparatus of claim 25, wherein the sampler comprises:

two or more samplers which in combination provide samples with an interval shorter than the length of at least some of the time finite signals between adjacent samples.

27. The apparatus of claim 25, wherein the number of multipliers is the smallest integer greater than the ratio between a length of the shifted time reversed versions of the multiplication signal and the interval between adjacent provided samples.

28. The apparatus of claim 25, further comprising:

a reconstructer adapted to generate a continuous time analog signal from the samples provided by the sampler.

29. The apparatus of claim 25, further comprising:

a digitizer adapted to generate discrete-value samples from the samples provided by the sampler.

30. An apparatus of claim 25, wherein the two or more multipliers and the two or more integrators are included in two or more combined multiplication and integration circuits, respectively.

31. The apparatus of claim 30, wherein a combined multiplication and integration circuit of the two or more combined multiplication and integration circuits comprises:

a complex multiplier and a complex integrator adapted to process a complex input signal with time reversed versions of a complex multiplication signal.

* * * * *